US006253730B1

(12) United States Patent
Gustafson

(10) Patent No.: US 6,253,730 B1
(45) Date of Patent: Jul. 3, 2001

(54) ENGINE COMPRESSION BRAKING SYSTEM WITH INTEGRAL ROCKER LEVER AND RESET VALVE

(75) Inventor: Richard J. Gustafson, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/482,873

(22) Filed: Jan. 14, 2000

(51) Int. Cl.[7] ..... F02D 13/04
(52) U.S. Cl. ..... 123/321
(58) Field of Search ..... 123/90.15, 321, 123/322

(56) References Cited

U.S. PATENT DOCUMENTS

| | | | |
|---|---|---|---|
| 3,220,392 | 11/1965 | Cummins | 123/321 |
| 3,332,405 | 7/1967 | Haviland | 123/321 |
| 3,405,699 | 10/1968 | Laas | 123/320 |
| 3,786,792 | 1/1974 | Pelizzoni et al. | 123/321 |
| 3,809,033 | 5/1974 | Cartledge | 123/90.46 |
| 4,399,787 | 8/1983 | Cavanagh | 123/321 |
| 4,423,712 | 1/1984 | Mayne et al. | 123/321 |
| 4,475,500 | 10/1984 | Bostelman | 123/321 |
| 4,996,957 | 3/1991 | Meistrick | 123/321 |
| 5,386,809 | 2/1995 | Reedy et al. | 123/320 |
| 5,507,261 * | 4/1996 | Johnson, Jr. | 123/322 |
| 5,626,116 | 5/1997 | Reedy et al. | 123/321 |
| 5,680,841 | 10/1997 | Hu | 123/322 |
| 5,718,199 | 2/1998 | Hu et al. | 123/322 |

FOREIGN PATENT DOCUMENTS

93/25803 12/1993 (WO) .

* cited by examiner

*Primary Examiner*—Tony M. Argenbright
(74) *Attorney, Agent, or Firm*—Nixon Peabody LLP; Charles M. Leedom, Jr.; Tim L. Brackett

(57) ABSTRACT

An engine compression braking system having an integral rocker lever and reset valve utilizes a single rocker lever to operate an engine in both normal power and braking modes while effectively closing an exhaust valve to define a braking mode exhaust valve opening event prior to a primary opening event. The system includes a reset valve mounted on the rocker arm a spaced distance from an actuator piston to relieve fluid pressure from a high pressure circuit after an initial opening of the exhaust valve. A reset contact element is mounted on a stationary engine component for engagement by the reset valve during movement of the rocker lever to cause opening of the reset valve and relief of the pressure. In one embodiment, a bias chamber and bias chamber supply circuit are provided to permit low pressure braking fluid to be continuously supplied to an actuator supply circuit.

24 Claims, 8 Drawing Sheets

ENGINE COMPRESSION BRAKING SYSTEM WITH INTEGRAL ROCKER LEVER AND RESET VALVE

TECHNICAL FIELD

This invention relates to compression braking systems for internal combustion engines for selectively operating an engine in either a power mode or a braking mode, i.e. compression braking. More specifically, this invention relates to a simple, effective compression braking system capable of minimizing the size and weight of the associated engine while providing optimal predictable compression braking.

BACKGROUND OF THE INVENTION

For many internal combustion engine applications, such as for powering heavy trucks, it is desirable to operate the engine in a braking mode. This approach involves converting the engine into a compressor by cutting off the fuel flow and opening the exhaust valve for each cylinder near the end of the compression stroke.

An early technique for accomplishing the braking effect is disclosed in U.S. Pat. No. 3,220,392 to Cummins, wherein a slave hydraulic piston located over an exhaust valve opens the exhaust valve near the end of the compression stroke of an engine piston with which the exhaust valve is associated. To place the engine into braking mode, three-way solenoids are energized which cause pressurized lubricating oil to flow through a control valve, creating a hydraulic link between a master piston and a slave piston. The master piston is displaced inward by an engine element (such as a fuel injector actuating mechanism) periodically in timed relationship with the compression stroke of the engine which in turn actuates a slave piston through hydraulic force to open the exhaust valves. The compression brake system as originally disclosed in the '392 patent has evolved in many aspects, including improvements in the control valves (see U.S. Pat. Nos. 5,386,809 to Reedy et al. and U.S. Pat. No. 4,996,957 to Meistrick) and the piston actuation assembly (see U.S. Pat. No. 4,475,500 to Bostelman). A typical modern compression braking system found in the prior art is shown in U.S. Pat. No. 4,423,712 to Mayne et al. where the exhaust valves are normally operated during the engine's power mode by an exhaust rocker lever. To operate the engine in a braking mode, a control valve separates the braking system into a high pressure circuit and a low pressure circuit using a check valve which prevents flow of high pressure fluid back into the low pressure supply circuit, thereby allowing the formation of a hydraulic link in the high pressure circuit. A three-way solenoid valve, positioned upstream of the control valve, controls the flow of low pressure fluid to the control valve, and thus, controls the beginning and end of the braking mode.

The system disclosed in Mayne el al. also includes a reset valve which operates to cause the slave piston to retract after an initial opening of the exhaust valve during braking. As a result, the exhaust valve is closed prior to the end of the expansion stroke and before the hydraulic pressure drops due to a return motion of the master piston. This design advantageously avoids shock or asymmetric loading of the crosshead by the exhaust rocker arm at the start of the main opening event of the exhaust valve following the initial opening event. However, the reset valve is formed in the slave cylinder for contact, and thus tripping, by the slave piston. Thus, the reset valve relies on the movement of the slave piston relative to the piston housing. Also, the reset valve is closed when the engine is operating in a power mode thereby undesirably creating a small volume in the slave piston which is not connected to the low pressure drain. As a result, air pockets may form in this volume disrupting slave piston or reset valve motion thereby possibly adversely affecting the predictability of the braking event.

U.S. Pat. No. 5,680,841 to Hu discloses an electro-hydraulic engine valve control system for permitting engine braking operation which includes a slave piston mounted in a bore formed in a rocker lever, a control oil circuit formed in the rocker lever and rocker shaft and a check valve positioned in the oil control circuit between the slave piston and a central oil passage formed in the rocker shaft. The system also includes an electronically controlled valve and an accumulator positioned along the oil control circuit. However, this system uses a cam profile which causes the exhaust valve to completely close between the initial opening of the exhaust valve and the primary opening of the exhaust valve during braking. This invention also requires the electronic control solenoid valve to open and close every engine cycle in both power and braking modes. Also, this design appears to undesirably require a solenoid for each cylinder.

Therefore, there is a need for an improved engine compression braking system having an integral rocker lever and reset valve capable of effectively avoiding asymmetric loading of a valve crosshead while providing accurate and predictable compression braking.

SUMMARY OF THE INVENTION

It is, therefore, an object of the present invention to overcome the deficiencies of the prior art and to provide an engine compression braking system capable of utilizing an integral rocker lever and reset valve to achieve optimum compression braking.

Another object of the present invention is to provide an engine compression braking system which incorporates a slave piston into the rocker lever along with a reset valve while eliminating other components of conventional systems, such as a control valve, master piston, adjusting screw and brake housing.

A further object of the present invention is to provide an engine braking system at a reduced cost while also minimizing weight and size.

Yet another object of the present invention is to provide an engine braking system including an integrated rocker lever and slave piston and a cam having a profile which avoids reverse pivoting of the rocker lever between an initial opening of the exhaust valve during braking and a main opening event.

It is yet another object of the present invention to provide an engine compression braking system including a rocker lever and a reset valve integrated into the rocker lever which is capable of effectively causing the return of an exhaust valve to a closed position without the reverse pivot of the rocker arm.

A still further object of the present invention is to provide an integrated rocker lever and reset valve wherein the reset valve is positioned to be operated by contact with an adjacent engine component.

Yet another object of the present invention is to provide an engine braking system including an integrated rocker lever and slave piston wherein the slave piston is positioned in a bore continuously connected to a braking fluid supply when the engine brake is off and the engine is operating in a normal power mode.

These and other objects are achieved by providing a braking system for an internal combustion engine having at least one engine piston reciprocally mounted within a cylinder for cyclical successive compression and expansion strokes and at least one exhaust valve operable to open near the end of an expansion stroke of the engine piston when the engine is operated in a power mode and operable to open in a timed relationship to the engine piston compression stroke when the engine is operated in a braking mode. The braking system includes a rocker lever pivotally mounted adjacent the exhaust valve for opening the exhaust valve and a braking fluid circuit formed in the rocker lever and including a low pressure circuit and a high pressure circuit. The braking system further includes a control valve positioned along the braking fluid circuit and operable in a first position to cause engine operation in the power mode and a second position to cause engine operation in the braking mode. The braking system further includes an actuator piston bore formed in the rocker lever in communication with the high pressure circuit and an actuator piston slidably mounted in the actuator piston bore. In addition, the braking system includes a reset valve mounted on the rocker lever a spaced distance from the actuator piston so as to be free from contact with the actuator piston. The reset valve is operable to relieve fluid pressure from the high pressure circuit during operation in the braking mode. The reset valve may be movable between an open position permitting communication between the high pressure circuit and the low pressure circuit and a closed position blocking communication between the high pressure circuit and the low pressure circuit. The movement of the rocker lever in the present invention causes movement of the reset valve into the open position.

The braking system may further include a reset contact element mounted on the engine adjacent the rocker lever in position for contact by the reset valve during movement of the rocker lever to move the reset valve into an open position. The contact element is mounted for adjustment to vary a distance between the reset contact element and the reset valve. The reset valve includes a valve head positioned for abutment against a valve seat and a reset pin positioned in abutment against the valve head. The valve head may include a ball and the reset pin may be positioned for contact with the reset contact element. The reset valve may include a reset plunger positioned to contact the reset contact element wherein the reset pin extends between the valve head and the reset plunger. Further, a bias chamber may be included for receiving the reset plunger wherein fluid pressure in the bias chamber generates pressure forces on the reset plunger to move the reset plunger toward the reset contact element to cause movement of the reset valve into a closed position.

Preferably, movement of the reset valve into a closed position creates a hydraulic link in the high pressure circuit causing opening of the exhaust valve upon movement of the rocker lever to define a braking mode exhaust valve opening event. The low pressure circuit is connected to a low pressure braking fluid supply. The low pressure circuit may include an actuator supply circuit and a bias chamber supply circuit for delivering braking fluid to the bias chamber. The reset valve functions to control the flow through the actuator supply circuit. In this case, the control valve is movable into a first position to connect the bias chamber supply circuit to a low pressure drain and a second position to connect the bias chamber supply circuit to a low pressure braking fluid supply.

DETAILED DESCRIPTION OF THE INVENTION

Figure 1A:
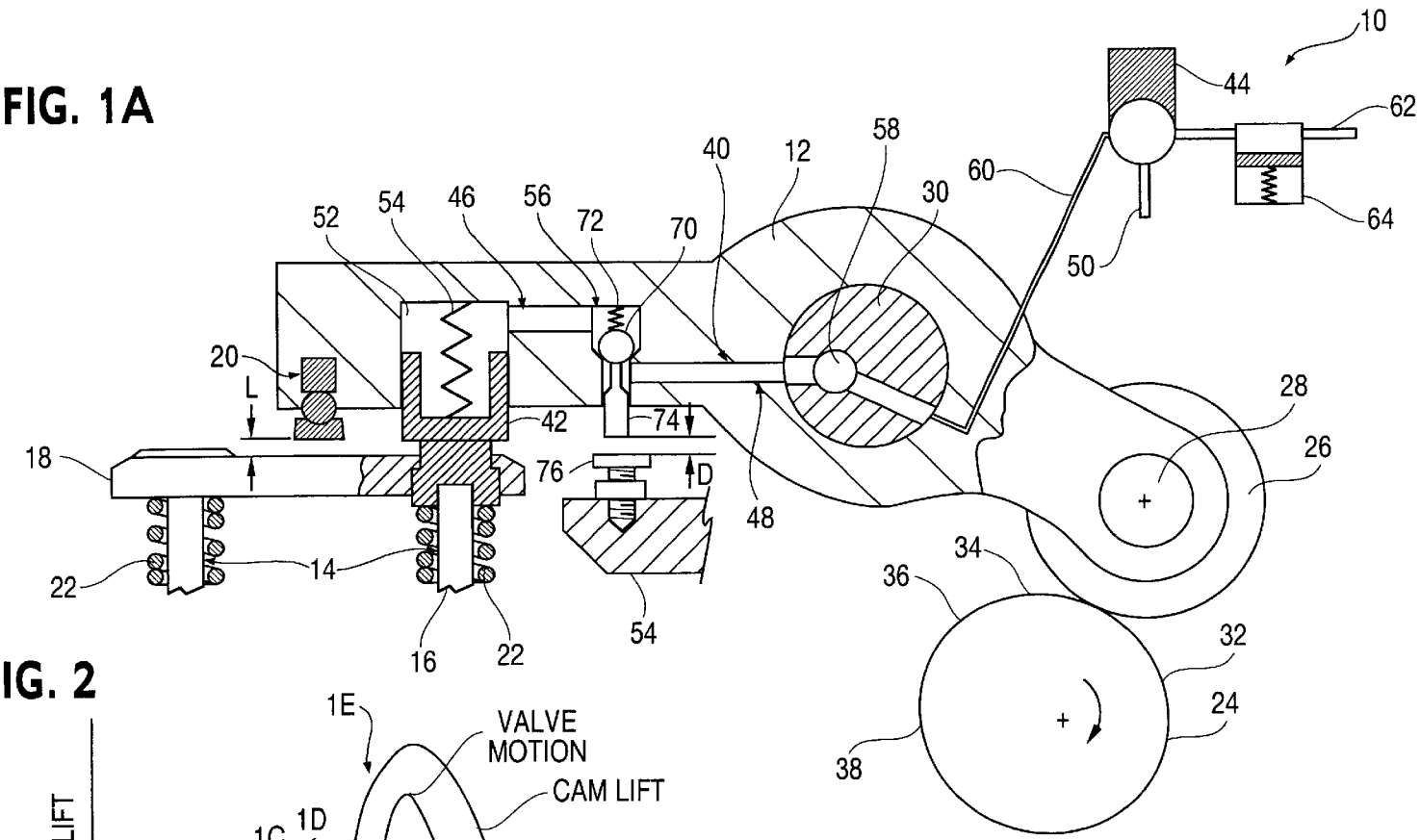
FIG. 1A is a diagrammatic illustration of the integrated rocker lever, slave piston and reset valve associated with the compression braking system of the present invention.

Referring to FIG. 1A, there is shown one embodiment of the compression braking system of the present invention, indicated generally at 10, for operating an internal combustion engine as a compressor when the engine is placed in a braking mode. In particular, FIG. 1A discloses a rocker lever 12 that operates to reciprocally displace one or more exhaust valves 14 during a normal power mode and a braking mode of operation. For example, in the preferred embodiment, in the power mode, rocker lever 12 displaces both exhaust valves 14 into the engine cylinder (not shown) during, for instance, the exhaust cycle of a four-cycle operation of the engine in order to exhaust combusted gas from the engine cylinder. When it becomes necessary or desirable to operate the engine in a braking mode, rocker lever 12 functions to displace only one exhaust valve 16 into the engine cylinder at the appropriate time during the engine cycle, e.g. near the end of the compression stroke of the engine piston (not shown), to exhaust the compressed gas from the cylinder. Exhaust valves 14 are mounted on a crosshead 18 positioned for abutment by rocker lever 12 via a contacting element such as a friction reducing swivel pad 20 mounted on one end of rocker lever 12. Exhaust valve 16 is mounted for downward movement into the engine cylinder independent of crosshead 18 and the other exhaust valve to permit single exhaust valve displacement in the braking mode. Exhaust valve springs 22 are used to bias exhaust valves 14 into the closed position.

Braking system 10 also includes a cam 24 mounted for timed rotation during the engine cycle. A cam roller 26, mounted on one end of rocker lever 12 via a roller pin 28, is positioned in biased abutment against the cam surface of cam 24. Rocker lever 12 is mounted for pivotal movement on a support shaft 30 fixedly mounted in the overhead portion of the engine. Cam 24 includes an inner base portion 32 whereupon rocker lever 12 is pivoted in a clockwise direction around support shaft 30 into a retracted position causing separation of rocker lever 12 and crosshead 18 by a predetermined lash L. While cam roller 26 is positioned on inner base portion 32, exhaust valves 14 are in the closed position. Cam 24 also includes a brake lift portion 34 which pivots rocker lever 12 in the counterclockwise direction around support shaft 30 to cause opening of exhaust valve 16 when the engine is operating in the braking mode as discussed more fully hereinbelow. Cam 24 further includes a dwell portion 36 which maintains rocker lever 12 in a predetermined pivoted position while avoiding reverse pivoting prior to a main exhaust valve opening event. Cam 24 also includes a main lift portion 38 following dwell portion 36 which functions to further pivot rocker lever 12 in a counterclockwise direction to cause the opening of both exhaust valves 14 during a main exhaust valve opening event as discussed more fully hereinbelow. It should be noted that cam 24 could be operatively connected to rocker lever 12 by a push rod or other drive train structure positioned between cam 24 and rocker lever 12 in a conventional manner.

Importantly, braking system 10 further includes a braking fluid circuit 40 formed at least partially within rocker lever 12, an actuator piston 42 mounted on rocker lever 12 adjacent exhaust valve 16, and a control valve 44 for controlling the flow of braking fluid through braking fluid circuit 40 so as to selectively place the particular engine cylinder or the entire engine in a braking mode. Braking fluid circuit 40 includes a high pressure circuit 46, a low pressure circuit 48 and a drain circuit 50. High pressure circuit 46 includes an actuator piston bore 52 for slidably receiving actuator piston 42. A bias spring 54, positioned in actuator piston bore 52, biases actuator piston 42 outwardly toward exhaust valve 16. As discussed more fully hereinbelow, braking system 10 also includes a reset valve 56 positioned between high pressure circuit 46 and low pressure circuit 48 to control the flow of braking fluid between high pressure circuit 46 and low pressure circuit 48 so as to control the movement of exhaust valve 16 during the braking mode. Low pressure circuit 48 includes transverse and axial passages 58 formed in support shaft 30 and transfer passages 60 extending from passages 58 to communicate with control valve 44. Transfer passages 60 are preferably formed in a shaft support (not shown) positioned to support support shaft 30. Braking control valve 44 is preferably a compact, three-way solenoid valve which functions to selectively control the beginning and end of the braking mode. During the normal power mode of engine operation, control valve 44 is de-energized to connect low pressure circuit 48 to drain circuit 50. When engine braking is desired, control valve 44 is energized to connect low pressure circuit 48 to a braking fluid supply line 62 connected to a supply of braking fluid, i.e. engine lubricating oil. Control valve 44 therefore remains energized during the braking mode. A braking fluid accumulator 64 may be provided along braking fluid supply line 62 to ensure a sufficient quantity, and a steady flow, of braking fluid through the low pressure and high pressure circuits 48, 46. Control valve 44 is controlled by an engine control module (not shown) which provides signals to valve 44 to cause energization and de-energization of the associated actuator, i.e. solenoid. Also, preferably, control valve 44 and accumulator 64 are mounted on a shaft support (not shown) supporting support shaft 30.

Referring to FIG. 1A, reset valve 56 includes a valve head 70 biased into a closed position by a bias spring 72 to prevent flow between high pressure circuit 46 and low pressure circuit 48. In the present embodiment, valve head 70 is a ball-type valve. Reset valve 56 also includes a reset pin 74 slidably mounted in a bore formed on the low pressure circuit side of valve 56 immediately adjacent the valve seat for abutment by valve head 70. Thus, reset pin 74 is positioned to contact and move valve head 70 against the force of bias spring 72 as discussed more fully hereinbelow. A reset contact element 76 is mounted on an engine component, for example a pedestal 54, immediately adjacent a lower end of reset pin 74. Reset contact element 76 is positioned a predetermined spaced distance from reset pin 74 when cam roller 26 is positioned on the inner base portion 32 of cam 24 prior to actuation of exhaust valves 14. During the initial pivoting movement of rocker lever 12 caused by brake lift portion 34 of cam 24, reset pin 74 will contact reset contact element 76 causing reset pin 74 to move upwardly as shown in FIG. 1A thereby moving valve head 70 off its seat from a closed position into an open position resulting in the closing of exhaust valve 16. It should be noted that the lash L between element 20 and crosshead 18 is set to be larger than the predetermined distance D between reset contact element 76 and reset pin 74. Reset contact element 76 is preferably adjustably mounted by, for example, a threaded bolt and nut arrangement.

Figure 2:
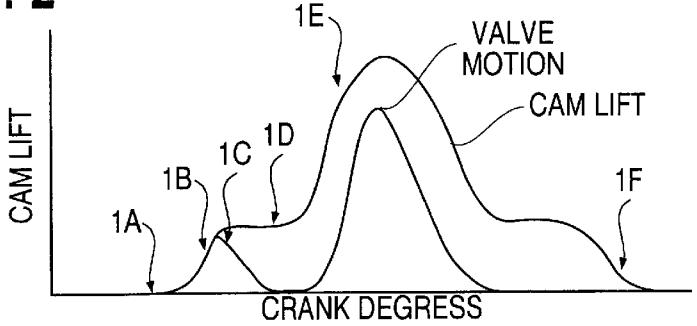
FIG. 2 is a graph of the cam lift versus crank degrees for a typical braking event showing the various stages of the cam lift and valve motion.
Figure 1B:
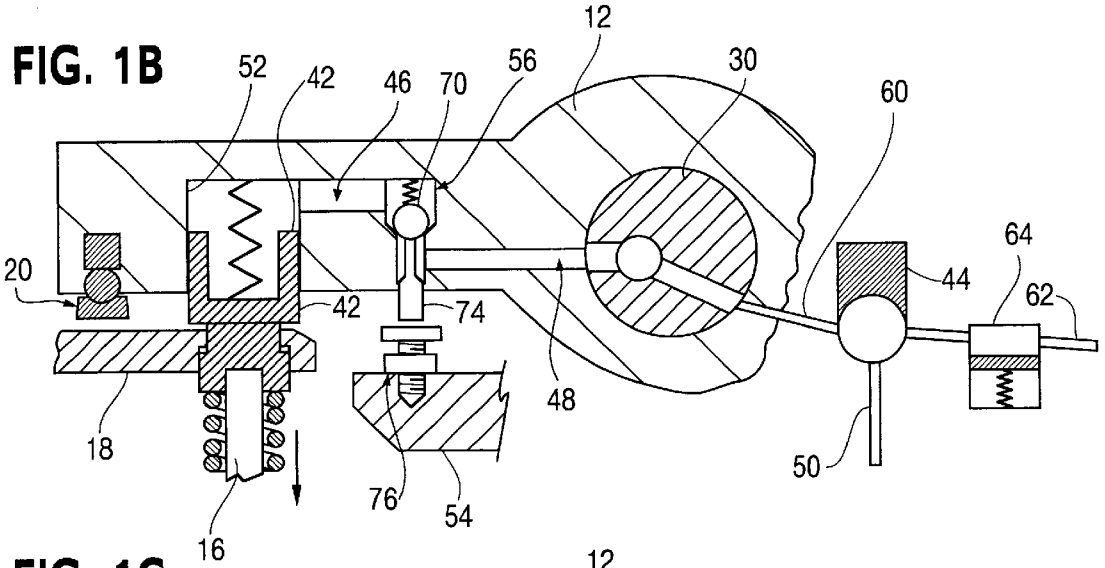
FIG. 1B is a cross sectional view of a portion of the integrated rocker lever and reset valve during the brake lift portion of the cam of FIG. 1A to define the braking mode exhaust valve opening event.

The operation, and the structural and functional advantages, of the braking system 10 of the present invention may best be understood by the following detailed description of each stage of operation as shown in FIGS. 1A–1F and FIG. 2. The various cam lift positions and valve motion positions of each of the FIGS. 1A–1F are illustrated in FIG. 2. During normal engine operation in a power mode, control valve 44 is de-energized blocking flow from braking fluid supply line 62 while connecting transfer passages 60 to drain circuit 50. During the normal power mode of operation, high pressure circuit 46 is not filled with braking fluid. As cam 24 rotates, although brake lift portion 34 causes rocker lever 12 to pivot, actuator piston 42 merely moves inwardly into actuator piston bore 52 without opening exhaust valve 16. However, main lift portion 38 then causes rocker lever 12 to pivot further resulting in element 20 contacting crosshead 18 and moving crosshead 18 downwardly so as to open exhaust valves 14 to defme a normal power mode exhaust valve opening event. When braking is desired, the engine ECU (not shown) signals energization of control valve 44 which closes drain circuit 50 and fluidically connects transfer passages 60 to braking fluid supply line 62. Low pressure braking fluid flows through low pressure circuit 48, including transfer passages 60 and passages 58 and into high pressure circuit 46 by forcing valve head 70 open against the bias force of spring 72. Thus, actuator piston bore 52 is filled with low pressure braking fluid and reset valve 56 immediately closes to the position shown in FIG. 1A. It should be noted that control valve 44 only needs to energize when braking is desired and therefore control valve 44 does not energize and de-energize every engine cycle. During rotation of cam 24 as brake lift portion 34 is encountered by cam roller 26, rocker lever 12 begins to pivot in a counterclockwise direction around support shaft 30. As previously noted, the crosshead lash L for normal valve actuation is set so large that rocker lever 12 and crosshead 18 do not contact during the brake lift portion 34. However, since braking fluid has filled high pressure circuit 46 and thus actuator piston bore 52, a hydraulic link is created in high pressure circuit 46 preventing actuator piston 42 from moving inwardly as piston 42 pushes against exhaust valve 16. Reset valve 56 functions as a check valve to prevent the flow of braking fluid from high pressure circuit 46 thereby creating the hydraulic link. As a result, brake lift portion 34 of cam 24 and the initial braking movement of rocker lever 12 causes actuator piston 42 to move exhaust valve 16 to an open position as shown in FIG. 1B without moving crosshead 18. Consequently, compressed gas within an engine cylinder is released to the exhaust system to achieve the engine braking effect desired.

Figure 1C:
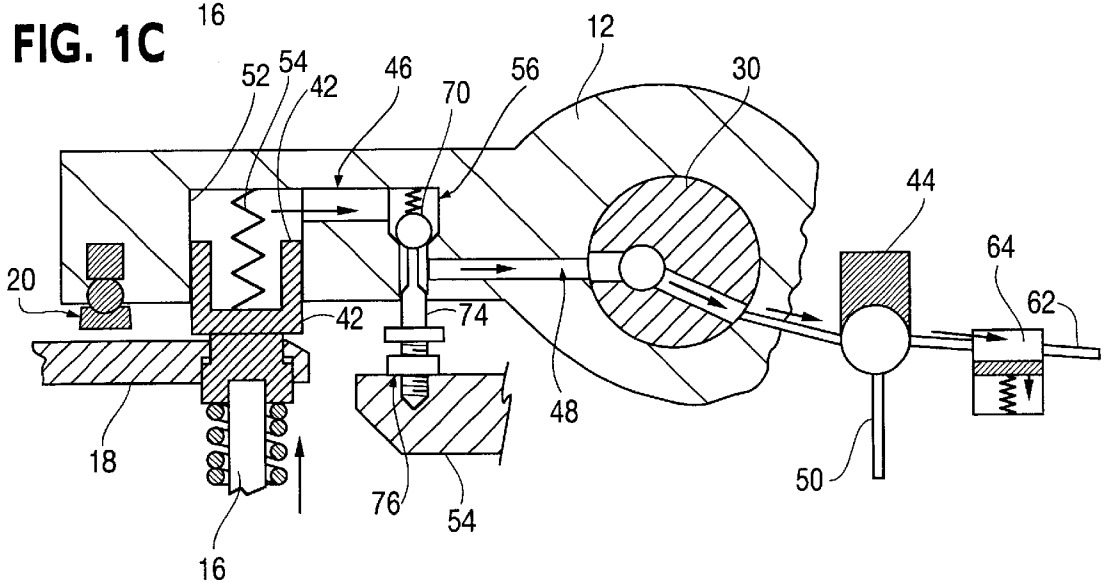
FIG. 1C is a cross sectional view of the integrated rocker lever and reset valve immediately after tripping of the reset valve.
Figure 1D:
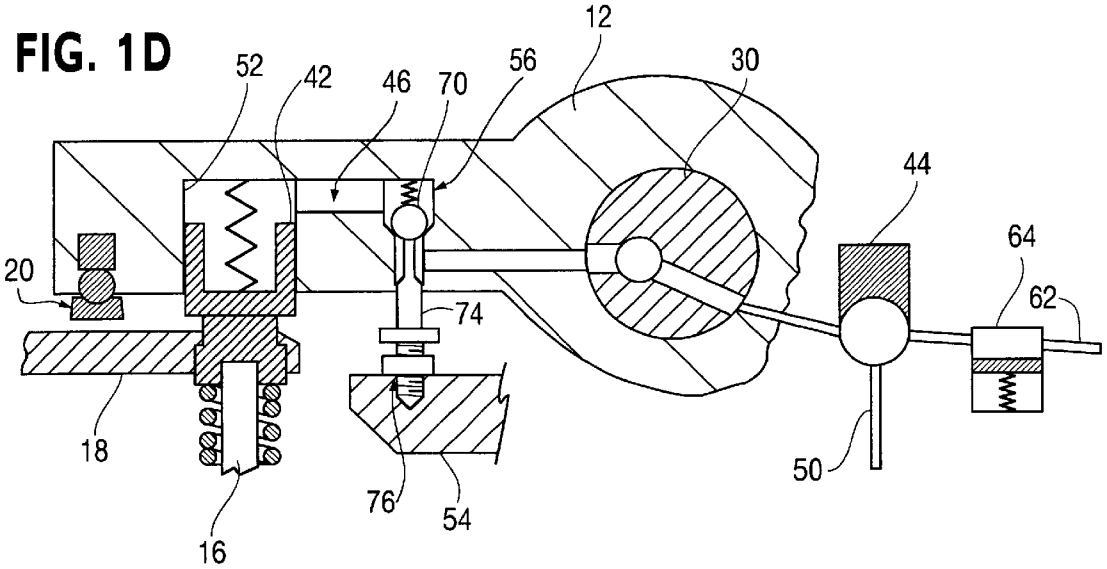
FIG. 1D is a cross sectional view of the rocker lever and reset valve of the present invention during the dwell portion of the cam of FIG. 1A occurring between the braking mode exhaust valve opening event and a main exhaust valve opening event.
Figure 1E:
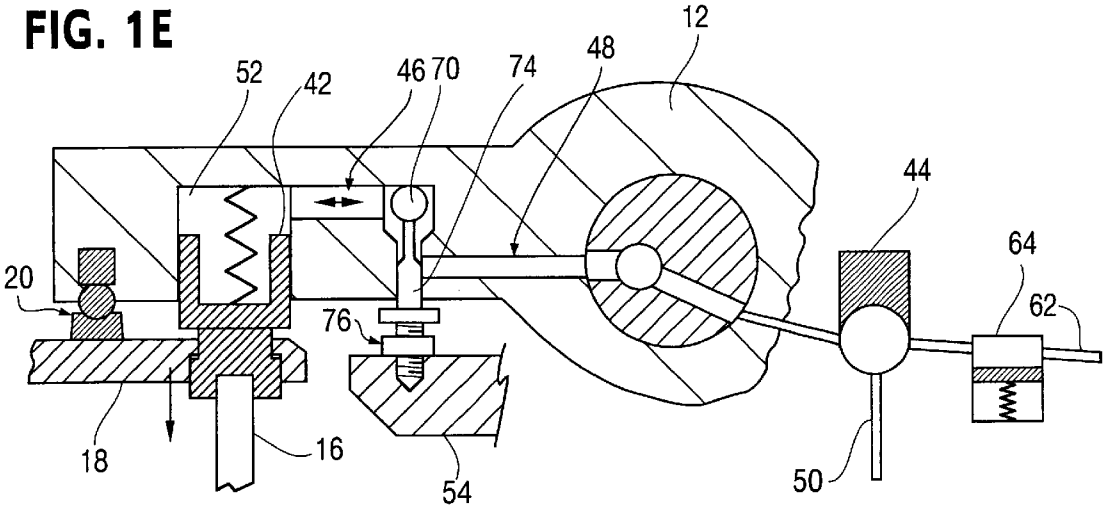
FIG. 1E is a cross sectional view of the integrated rocker lever and reset valve of the present invention during the main lift portion of the cam of FIG. 1A.
Figure 1F:
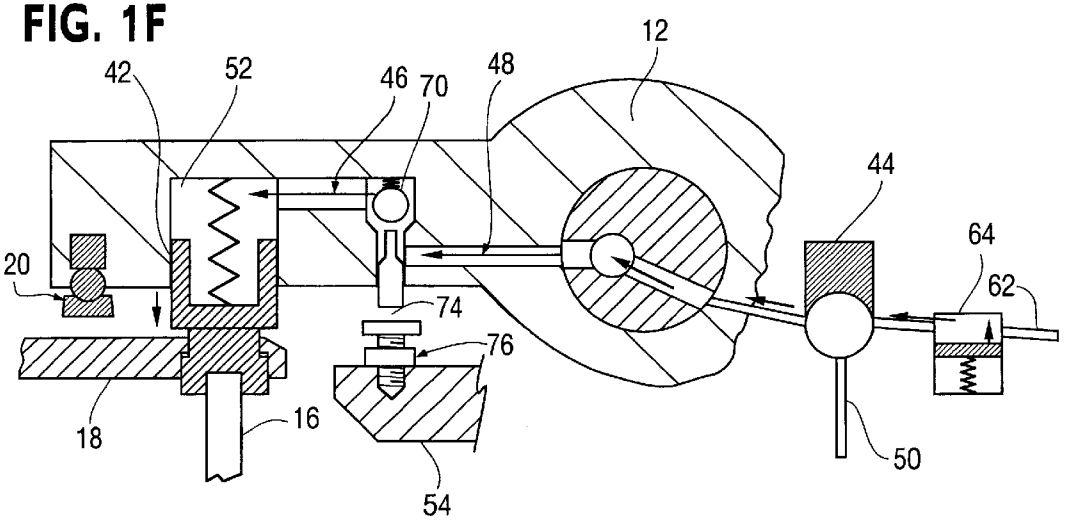
FIG. 1F is an illustration of the compression braking system of the present invention including a cross sectional view of the integrated rocker lever and reset valve during retraction of the rocker lever from the crosshead.

During the braking mode exhaust valve opening event, the reset pin lash will be reduced to zero causing reset pin 74 to contact reset contact element 76 forcing reset pin 74 upwardly as shown in FIG. 1C causing valve head 70 to move into an open position. Pressurized braking fluid in high pressure circuit 46 will then flow through high pressure circuit 48 into accumulator 64 as shown in FIG. 1C. As actuator piston 42 moves inwardly into actuator piston bore 52, exhaust valve 16 will close due to the force of valve return spring. During the dwell portion 36 and the main lift portion 38 of cam 24, reset valve 56 is maintained in an open position allowing the free flow of braking fluid between high pressure circuit 46 and braking fluid supply line 62, including accumulator 64 as shown in FIGS. 1D and 1E. Specifically, referring to FIG. 1E, during the main lift portion 38 of cam 24, rocker lever 12 continues to pivot in the counterclockwise direction around support shaft 30 causing element 20 to contact crosshead 18 and force crosshead 18 and thus valves 14 downwardly as shown in FIG. 1E. As cam 24 continues to rotate and cam roller 26 moves from main lift portion 38 back to inner base portion 32, rocker lever 12 will pivot in the counterclockwise direction. As shown in FIG. 1F, a valve return spring force will cause exhaust valves 14 to move into the closed position and crosshead 18 to move upwardly. Although rocker lever 12 and specifically element 20 separates from crosshead 18, actuator piston 42 will be maintained in contact with the outer end of exhaust valve 16 by low pressure braking fluid flowing into actuator piston bore 52 via reset valve 56. Although reset pin 74 has separated from reset contact element 76 during the retraction pivot movement of rocker lever 12, the flow of low pressure braking fluid into actuator piston bore 52 due to the movement of actuator piston 42 outwardly causes the low pressure braking fluid to force valve head 70 into an open position against the bias force of spring 72. Valve head 70 separates from reset pin 74 to allow much less restriction during the low pressure fill by moving above the high pressure passage connecting reset valve 56 to actuator piston bore 52. When actuator piston bore 52 fills with braking fluid and the inner base portion 32 is reached, bias spring 72 will force valve head 70 into the closed position in preparation for another cycle as shown in FIG. 1B.

Figure 3B:
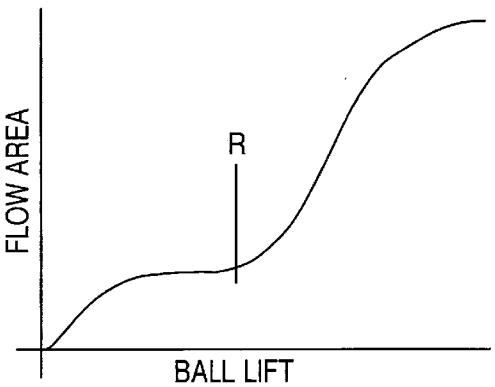
FIG. 3B is a graph of the cross sectional flow area through the reset ball valve versus ball lift.
Figure 3A:
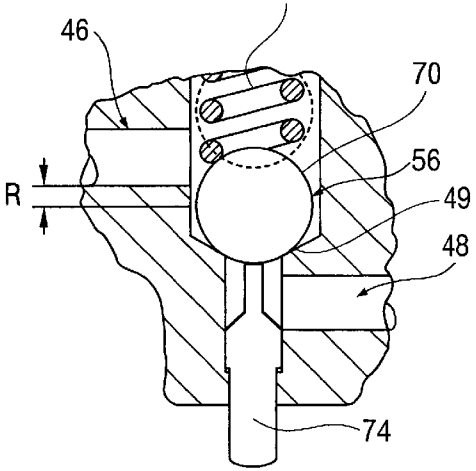
FIG. 3A is a cutaway, exploded cross sectional view of the reset valve of the present invention illustrating the reset ball geometry to control the exhaust valve seating velocity.

Referring to FIGS. 3A and 3B, it is important to control the exhaust valve seating velocity during the opening of reset valve 56 immediately upon contact with reset contact element 76. As shown in FIG. 1C, when reset valve 56 moves into an open position, high pressure fluid quickly escapes from high pressure circuit 46 causing the hydraulic link in high pressure circuit 46 and actuator piston bore 52 to collapse. In response, actuator piston 42 quickly moves inwardly toward actuator piston bore 52. The present invention effectively controls the flow of high pressure fluid escaping high pressure circuit 46 thereby preventing exhaust valve 16 from slamming shut and causing excessive wear and stress on exhaust valve 16 and its associated valve seat. The exhaust valve seating velocity is controlled by designing reset valve 56 with a check ball geometry sufficient to initially restrict the flow around check ball 70 upon initial opening while becoming relatively insensitive to the lift of check ball 70 after the initial lift of the check ball as shown in FIG. 3B. As shown in FIG. 3A, high pressure passage 47 is positioned relative to valve seat 49 and check ball 70 sized so that the smallest effective flow area between check ball 70 and the opposing wall of rocker lever 12 is positioned a predetermined axial distance R from passage 47. As a result, as shown in FIG. 3B, during the initial opening lift of check ball 70, the total cross sectional flow area through reset valve 56 is restricted to a predetermined maximum area A until check ball 70 has lifted an axial distance greater than R into a new position, for example as shown by the dashed lines in FIG. 3A, at which point the cross sectional flow area increases as passage 47 is uncovered. This design makes the reset velocity relatively insensitive to reset lash while the exhaust valve seating velocity remains the same.

Figure 4:
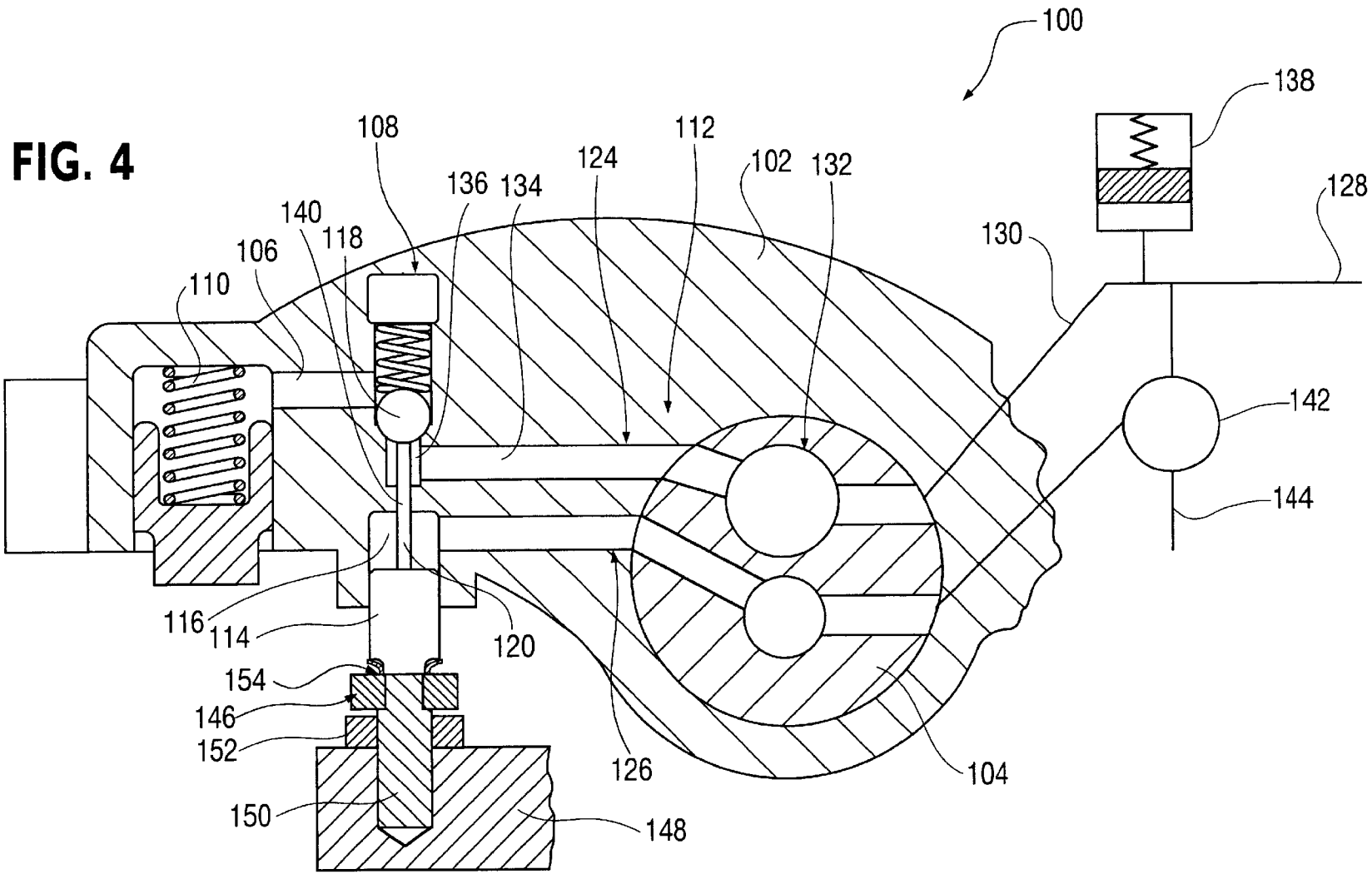
FIG. 4 is a diagrammatic illustration of a second embodiment of the compression braking system of the present invention.

FIG. 4 illustrates a second embodiment of the braking system of the present invention indicated generally at 100 which is similar to the previous embodiment in that a rocker lever 102 is pivotally mounted on a support shaft 104 for pivoting motion by the cam and cam roller arrangement of FIG. 1A so as to open and close exhaust valve 16 of FIG. 1A during a braking mode and open both valves 14 during a normal engine power mode of operation. Thus, the braking system 100 of the present embodiment may be utilized with the cam roller 26, cam 24, crosshead 18 and exhaust valves 14 of the embodiment of FIG. 1A even though these components are not shown in FIG. 4 for simplicity purposes. The present embodiment fundamentally differs from the previous embodiment in that low pressure braking fluid is continuously supplied to high pressure circuit 106 when the engine is operating in the normal power mode and when the engine is operating in the braking mode except during the braking mode exhaust valve opening event. Thus, in the present embodiment, a reset valve 108 is designed to be maintained in an open position at all times except to create the hydraulic link within high pressure circuit 106 and actuator piston bore 110 to cause the exhaust valve to open during the braking mode event.

Specifically, reset valve 108 includes a reset plunger 114 positioned in a bore formed in rocker lever 102 to create a bias chamber 116. Reset valve 108, like the previous embodiment, includes a ball check valve 118 and a reset pin 120. However, reset pin 120 extends through rocker lever 102 for abutment against reset plunger 114. Low pressure braking fluid circuit 122 includes an actuator supply circuit 124 and a bias chamber supply circuit 126 positioned in parallel. Actuator supply circuit 124 delivers low pressure braking fluid from the supply 128 through passages 130 formed in, for example, shaft supports (not shown) for supporting support shaft 104, transfer passages 132 formed in support shaft 104 and a passage 134 connecting passages 132 to a supply cavity 136 immediately adjacent check ball 118. An accumulator 138 is positioned along actuator supply circuit 124. Therefore, supply cavity 136 is continuously connected to braking fluid supply 128. Bias chamber supply circuit 126 connects at one end to bias chamber 116 and at an opposite end to actuator supply circuit 124 via passages formed in rocker lever 102, support shaft 104 and other engine components such as a shaft support. Importantly, reset pin 120 extends from supply cavity 136 through a sealing bore 140 into bias chamber 116 for abutment against reset plunger 114. Reset pin 120 may be formed integrally with or separate from reset plunger 114. Thus, as can be appreciated, supply cavity 136 is fluidically separate from bias chamber 116. A control valve 142, similar to that of the previous embodiment, connects bias chamber supply circuit 126 to a drain 144 during operation of the engine in normal power mode. When braking is desired, control valve 142 is energized to connect bias chamber supply circuit 126 to braking fluid supply 128. A reset contact element 146 is mounted on an engine component, such as pedestal 148, for abutment by reset plunger 114. Preferably, reset contact element 146 is mounted to adjustably set the reset lash or distance between reset contact element 146 and reset plunger 114. For example, reset contact element 146 may include a threaded bolt 150 and a threaded locknut 152 for adjustably securing bolt 150 in an axial position so that a predetermined portion of bolt 150 extends from pedestal 148.

During operation of the embodiment shown in FIG. 4, with the engine operating in the normal power mode, control valve 142 is de-energized to connect bias chamber supply circuit 126 to drain 144. Meanwhile, actuator supply circuit 124 is continuously connected to low pressure braking fluid supply 128. As a result, bias chamber 116 is connected to the vent/drain 144. Thus, reset check ball 118 is moved into an open position by the low pressure braking fluid in supply cavity 136 acting on reset check ball 118 in combination with the biasing force of a bias spring 154, i.e. a leaf or coil spring, positioned between reset plunger 114 and the upper end of reset contact element 146. Alternatively, bias spring 154 may be positioned between reset plunger 114 and rocker lever 102. As a result, during normal power mode operation, a hydraulic link is not created in high pressure circuit 106 and thus the exhaust valves are not opened during the brake lift portion of the cam (FIG. 1A). Moreover, reset plunger 114 does not contact reset contact element 146 during the main lift portion of the cam. When braking is desired, control valve 142 is energized to connect bias chamber supply circuit 126 to low pressure braking fluid supply 128 while blocking flow to the vent/drain 144. Consequently, low pressure braking fluid flows through bias chamber supply circuit 126 into bias chamber 116 causing reset plunger 114 to move downwardly compressing the bias spring 154 and contacting reset contact element 146. As a result, reset check ball 118 and reset pin 120 (if not formed integrally with reset plunger 114) move downwardly allowing reset check ball 118 to seat in its closed position. When the cam begins the brake lift portion, the braking fluid trapped in high pressure circuit 106 and piston bore 110 creates a hydraulic link maintaining the actuator piston in an outward position and causing the exhaust valve or valves to open to allow compression relief from the combustion chamber (not shown).

The primary advantage of the system disclosed in FIG. 4 is the ability to maintain braking fluid in the portion of the system which controls operation of the actuator piston and reset valve 108 throughout engine operation in both the power and braking modes thereby reducing the adverse affects of transients when going between the power and braking modes. Specifically, if actuator supply circuit 124 were not continuously connected to low pressure braking fluid supply 128, e.g. communication blocked during engine operation in the power mode, air pockets may develop in the low and high pressure circuits. When switching back to the braking mode, these air pockets may then cause unpredictable braking operation until filled with fluid. The present embodiment ensures that high pressure circuit 106, actuator piston bore 110 and actuator supply circuit 124 are continuously connected to low pressure braking fluid supply 128 thereby minimizing the likelihood of air pockets and partial fill conditions which may result in large transient loads in the system during the brake on and off events thus avoiding the delay in waiting for the passages to purge air and fill thereby ensuring more reliable operation.

Figure 5A:
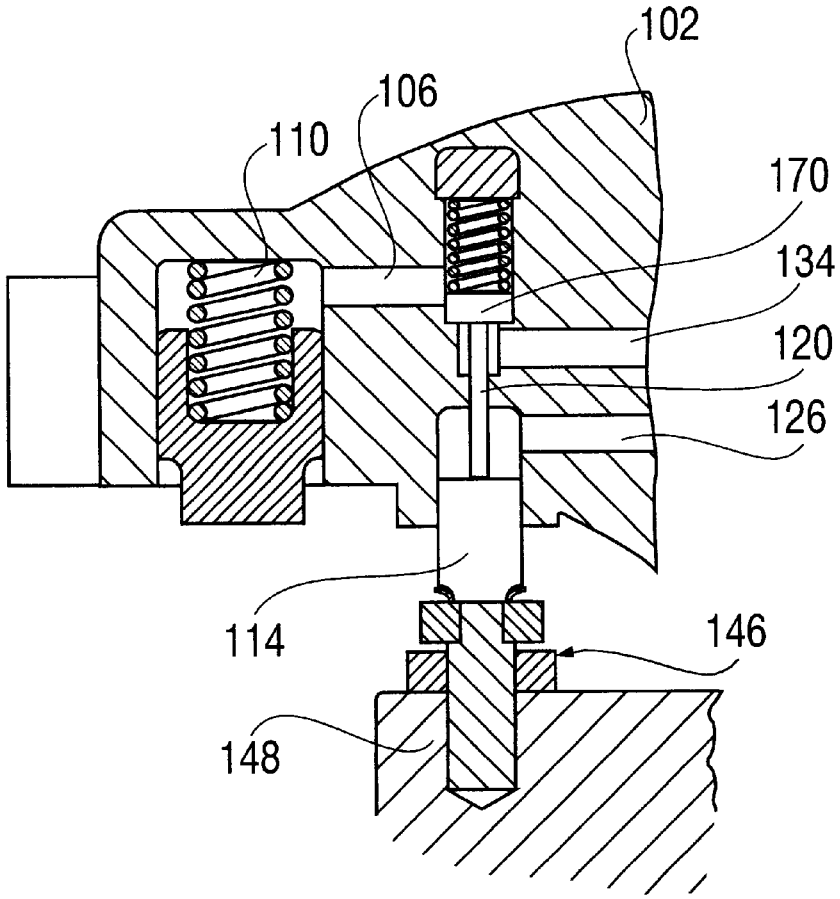
FIG. 5A is an alternative embodiment of the reset valve for the compression braking system of FIG. 4.
Figure 5B:
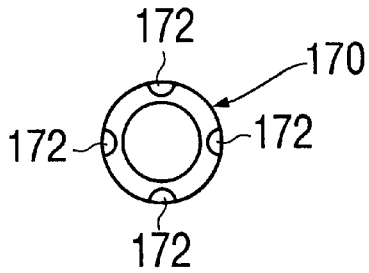
FIG. 5B is an end view of the cylindrical reset valve head of the embodiment of FIG. 5A.

FIGS. 5A and 5B illustrate another embodiment of the present invention which is the same as the previous embodiment of FIG. 4 except that a reset disk 170 is utilized instead of reset check ball 118. Of course, reset disk 170 could also be used in the embodiment of FIGS. 1A–1F. Reset disk 170 is designed to reduce stresses at the reset disk/reset pin interface and at the reset disk/valve seat interface. The flow restriction discussed hereinabove relative to reset check ball 118 is achieved with the reset disk 170 of the present design by the use of flutes 172 formed along the outer surface of disk 170 as shown in FIG. 5B.

Figure 6:
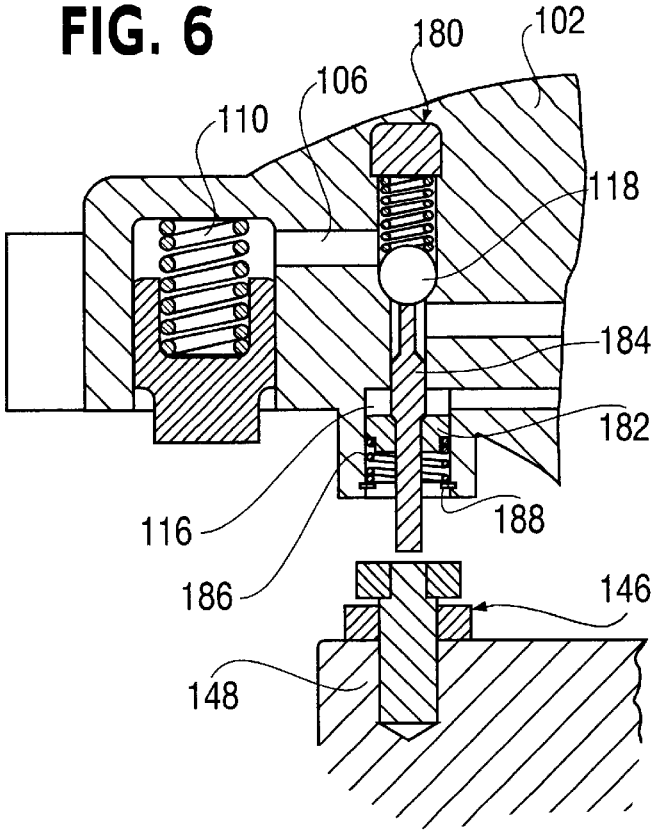
FIG. 6 is an alternative embodiment of the reset valve for use in the engine compression braking system of FIG. 4.

FIG. 6 illustrates yet another embodiment of the reset valve, indicated generally at 180, which is similar to the embodiment of FIG. 4 except that a modified reset plunger and reset pin is provided. Specifically, this embodiment includes a reset plunger 182 modified to allow a reset pin 184 to slide through plunger 182 in one direction, i.e. upwardly as shown in FIG. 6. Also, the leaf spring of the previous embodiment has been replaced by a helical coil spring 186 retained by a circular clip 188 positioned in a groove formed in the rocker lever. It should be noted that the function of spring 186 is the same as the function of the leaf spring in the embodiment of FIG. 4 in biasing reset plunger 182 upwardly and, therefore, a leaf spring could be used in place of coil spring 186. The operation of the assembly is essentially the same as the embodiment of FIG. 4, however, since reset pin 184 can slide through reset plunger 182, there is very little fluid flow through bias chamber supply circuit 126 when in the braking mode. Specifically, during the braking lift portion of the cam, when the rocker lever is pivoted and reset pin 184 contacts reset contact element 146, reset pin 184 moves upwardly forcing check ball 118 into an open position without requiring movement of reset plunger 182. Therefore, braking fluid need not be pushed out of bias chamber 116 into bias chamber supply circuit 126 while reset valve 180 is being moved into the open position. In addition, this design is more compact since the pin overtravel can be accommodated. When the control valve 142 (FIG. 4) is de-energized for the normal power mode, reset plunger 182 moves up and positions the check ball as shown by the phantom outline in FIG. 6. At this point, the braking fluid pressure in high pressure circuit 106 cannot increase since reset ball check 118 is held in the open position.

Figure 7:
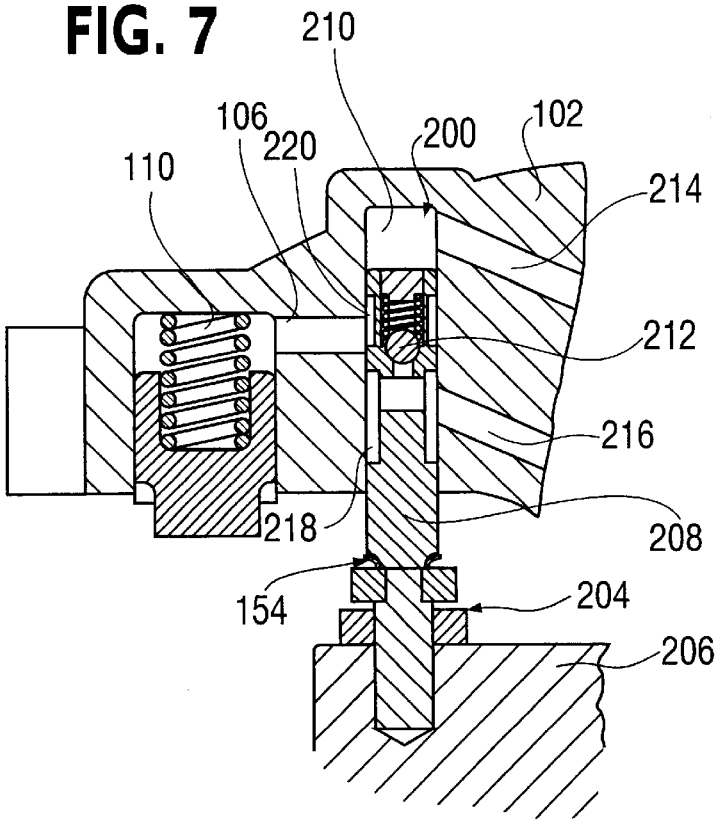
FIG. 7 is an alternative embodiment of the reset valve of the present invention for use in the engine compression braking system of FIG. 4.

FIG. 7 illustrates yet another embodiment of the reset valve for use in the engine braking system illustrated in FIG. 4. In this embodiment, the reset valve 200 still relies on the motion of the rocker lever 202 to contact a reset contacting element 204 on a pedestal 206. However, reset valve 200 includes a reset valve element 208 of the spool valve plunger type mounted in a bore formed in the rocker lever to form a bias chamber 210 positioned at the top of the bore. Reset valve 200 also includes a spring biased reset check ball 212 positioned within spool valve plunger 208. The bias chamber 210 is connected to a bias chamber supply circuit 214 which is the same as bias chamber supply circuit 126 of the previous embodiment. An actuator supply circuit 216 connects to the upstream side of reset check ball 212 via a lower port 218 formed in spool valve plunger 208. An upper port 220 connects high pressure circuit 106 to a downstream side of reset check ball 212. Thus, when operating in the braking mode, with control valve 142 (FIG. 4) actuated, braking fluid is supplied through bias chamber supply circuit 214 to bias chamber 210 causing spool valve plunger 208 to move downwardly as shown in FIG. 7 thereby depressing leaf spring 154 to allow spool valve plunger 208 to contact reset contact element 204 on pedestal 206. In this position, high pressure circuit 106 is sealed from actuator supply circuit 216. However, if makeup braking fluid is required to fully charge high pressure circuit 106 and actuator piston bore 110, braking fluid will flow one way through check ball valve 212. As the cam 24 begins the brake lift portion 34 (FIG. 1A), braking fluid pressure will increase in actuator piston bore 110 and the exhaust valve or valves will open to allow compression relief. As the spool type plunger 208 continues to move upwardly, lower port 218 will register with high pressure circuit 106 thereby relieving high pressure from actuator piston bore 110 and allowing the exhaust valve to reset, i.e. seat in the closed position as with the previous embodiments. When the control valve 142 is de-energized and the engine placed in the normal power mode, the pressure in bias chamber supply circuit 214 is reduced to substantially zero pressure to allow leaf spring 154 to lift spool type plunger 208 to the point where lower port 218 is maintained in communication with high pressure circuit 106. Accordingly, the hydraulic link cannot be achieved in high pressure circuit 106 and actuator piston bore 110 thus preventing the actuator piston from actuating the exhaust valve during the brake lift rocker lever motion.

Figure 8A:
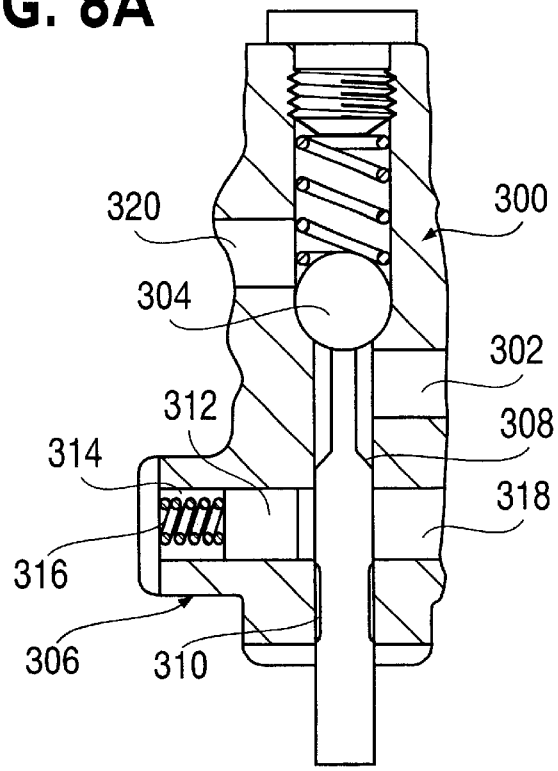
FIGS. 8A and 8B illustrate yet another embodiment of the reset valve of the present invention for use in the engine compression braking system of FIG. 4.
Figure 8B:
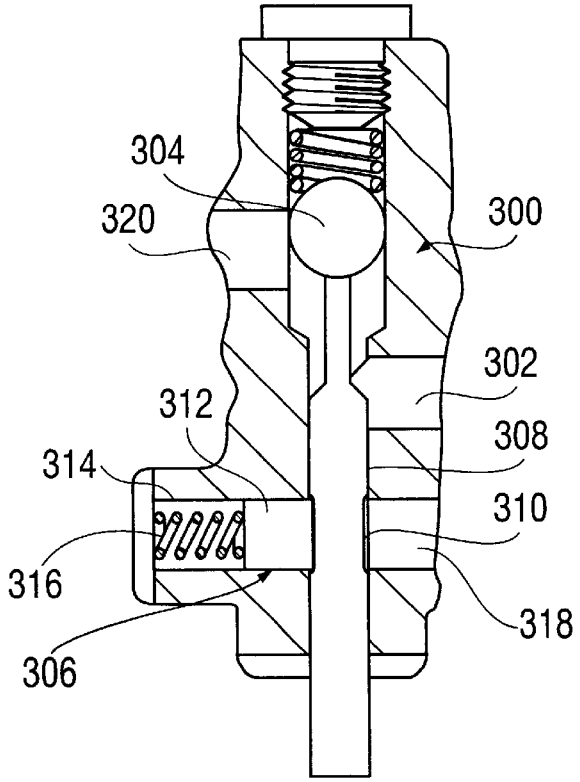

FIGS. 8A and 8B illustrate yet another embodiment of the reset valve for use in the engine braking system illustrated in FIG. 4. In this embodiment, the reset valve 300 still relies on the motion of the rocker lever (not shown) to contact a reset contacting element (not shown) mounted on the engine as shown in FIG. 4. However, instead of utilizing low pressure braking fluid from low pressure braking fluid supply 302 to hold check ball 304 off its seat during the power mode, a detent assembly 306 engages a reset pin 308 to hold the pin 308 and check ball 304 in the position shown in FIG. 8B. Specifically, reset pin 308 includes an elongated element having an annular recess 310 sized for engagement by detent assembly 306. Detent assembly 306 includes a detent pin 312 positioned in a detent bore 314 and a bias spring 316 for biasing detent pin 312 toward reset pin 308. Referring to FIG. 8A, when in the braking mode, control pressure from control pressure circuit 318 acts against detent pin 312 so as to move detent pin 312 to the left as shown in FIG. 8A against the bias force of spring 316 and out of engagement with reset pin 308. Thus, reset pin 308 may move downwardly into contact with the reset contact element while check ball 304 moves downwardly into a seated position as discussed in the previous embodiments. Referring to FIG. 8B, during the power mode, control pressure in circuit 318 is vented, as discussed in the previous embodiments, causing detent pin 312 to engage annular recess 310 of reset pin 308 as reset pin 308 moves upwardly. As a result, check ball 304 is moved off its seat into the open position. Low pressure braking fluid may then flow easily between actuator supply circuit 302 and high pressure circuit 320 preventing significant pressure build-up thereby preventing the exhaust valve from opening during the brake lift portion of the cam. The primary advantages of the present embodiment utilizing detent assembly 306 includes a more compact package and a relatively small braking fluid flow required through circuit 318 during operation, i.e. basically zero during braking operation and only a small amount moved during the on/off events.

The embodiments of the present invention described hereinabove advantageously permit the use of a single rocker lever for controlling actuation of exhaust valves during both normal power mode and braking mode operation while effectively achieving optimal braking operation with a compact design in a cost effective manner. The braking system of the present invention advantageously permits braking operation utilizing a single exhaust valve in an engine having dual exhaust valves mounted on a common crosshead, while avoiding asymmetric loading of the crosshead. In addition, the present invention effectively permits resetting or closing of the exhaust valve after an initial braking mode exhaust valve opening event independent of the movement of an actuator piston thereby more predictably controlling the resetting process. Moreover, the present engine braking system effectively reduces the likelihood of partial fill conditions and air pockets in the braking fluid circuit thereby enhancing the reliability and performance of the braking system.

INDUSTRIAL APPLICABILITY

The integral rocker lever and reset valve of the present invention can be utilized in an internal combustion engine for controlling the movement of any engine member to achieve an initial movement period followed by a resetting of the member. The integral rocker lever and reset valve is particularly suited for engine compression braking systems for use in heavy duty internal combustion engines used in vehicles.

I claim:

1. A braking system for an internal combustion engine having at least one engine piston reciprocally mounted within a cylinder for cyclical successive compression and expansion strokes and at least one exhaust valve operable to open near the end of an expansion stroke of the engine piston when the engine is operated in a power mode and operable to open in a timed relationship to the engine piston compression stroke when the engine is operated in a braking mode, said braking system comprising:

a rocker lever pivotally mounted adjacent said at least one exhaust valve for opening said exhaust valve;

a braking fluid circuit formed in said rocker lever and including a low pressure circuit and a high pressure circuit;

a control valve positioned along said braking fluid circuit and operable in a first position to cause engine operation in said power mode and a second position to cause engine operation in said braking mode;

an actuator piston bore formed in said rocker lever in communication with said high pressure circuit;

an actuator piston slidably mounted in said actuator piston bore; and a reset valve mounted on said rocker lever a spaced distance from said actuator piston so as to be free from contact with said actuator piston, said reset valve operable to relieve fluid pressure from said high pressure circuit during operation in said braking mode.

2. The braking system of claim 1, further including a reset contact element mounted on the engine adjacent said rocker lever and positioned for contact by said reset valve during movement of said rocker lever to move said reset valve into an open position.

3. The braking system of claim 2, wherein said reset contact element is mounted for adjustment to vary a distance between said reset contact element and said reset valve.

4. The braking system of claim 2, wherein said reset valve includes a valve head positioned for abutment against a valve seat, and a reset pin positioned in abutment against said valve head.

5. The braking system of claim of 4, wherein said valve head is a ball and said reset pin is positioned for contact with said reset contact element.

6. The braking system of claim 4, wherein said reset valve includes a reset plunger positioned to contact said reset contact element, said reset pin extending between said valve head and said reset plunger.

7. The braking system of claim 6, further including a bias chamber receiving said reset plunger, wherein fluid pressure in said bias chamber generates pressure forces on said reset plunger to move said reset plunger toward said reset contact element to cause movement of said reset valve into a closed position.

8. The braking system of claim 1, wherein said reset valve is movable into a closed position to create a hydraulic link in said high pressure circuit causing opening of the exhaust valve upon movement of said rocker lever to define a braking mode exhaust valve opening event, said low pressure circuit being connected to a low pressure braking fluid supply continuously throughout the braking mode and the power mode.

9. The braking system of claim 2, further including a bias chamber receiving said reset valve, wherein fluid pressure in said bias chamber generates pressure forces on said reset valve to move said reset valve toward said reset contact element to cause movement of said reset valve into a closed position, said low pressure circuit including an actuator supply circuit and a bias chamber supply circuit for delivering braking fluid to said bias chamber, said reset valve controlling flow through said actuator supply circuit.

10. The braking system of claim 9, wherein said control valve is movable into a first position to connect said bias chamber supply circuit to a low pressure drain and a second position to connect said bias chamber supply circuit to a low pressure braking fluid supply.

11. The braking system of claim 1, wherein said reset valve is movable into an open position permitting communication between said high pressure circuit and said low pressure circuit, further including a detent pin positioned to hold said reset valve in said open position when the engine is operated in the power mode.

12. The braking system of claim 11, wherein said reset pin includes an annular recess, said detent pin sized to engage said annular recess.

13. A braking system for an internal combustion engine having at least one engine piston reciprocally mounted within a cylinder for cyclical successive compression and expansion strokes and at least one exhaust valve operable to open near the end of an expansion stroke of the engine piston when the engine is operated in a power mode and operable to open in a timed relationship to the engine piston compression stroke when the engine is operated in a braking mode, said braking system comprising:

a rocker lever pivotally mounted adjacent said at least one exhaust valve for opening said exhaust valve;

a braking fluid circuit formed in said rocker lever and including a low pressure circuit and a high pressure circuit;

a control valve positioned along said braking fluid circuit and operable in a first position to cause engine operation in said power mode and a second position to cause engine operation in said braking mode;

an actuator piston bore formed in said rocker lever in communication with said high pressure circuit;

an actuator piston slidably mounted in said actuator piston bore; and a reset valve mounted on said rocker lever and movable between an open position permitting communication between said high pressure circuit and said low pressure circuit and a closed position blocking communication between said high pressure circuit and said low pressure circuit, wherein movement of said rocker lever causes movement of said reset valve into said open position.

14. The braking system of claim 13, further including a reset contact element mounted on the engine adjacent said rocker lever and positioned for contact by said reset valve during movement of said rocker lever to move said reset valve into an open position.

15. The braking system of claim 14, wherein said contact element is mounted for adjustment to vary a distance between said reset contact element and said reset valve.

16. The braking system of claim 14, wherein said reset valve includes a valve head positioned for abutment against a valve seat, and a reset pin positioned in abutment against said valve head.

17. The braking system of claim of 16, wherein said valve head is a ball and said reset pin is positioned for contact with said reset contact element.

18. The braking system of claim 16, wherein said reset valve includes a reset plunger positioned to contact said reset contact element, said reset pin extending between said valve head and said reset plunger.

19. The braking system of claim 18, further including a bias chamber receiving said reset plunger, wherein fluid pressure in said bias chamber generates pressure forces on said reset plunger to move said reset plunger toward said reset contact element to cause movement of said reset valve into a closed position.

20. The braking system of claim 13, wherein said reset valve is movable into a closed position to create a hydraulic link in said high pressure circuit causing opening of the exhaust valve upon movement of said rocker lever to define a braking mode exhaust valve opening event, said low pressure circuit being connected to a low pressure braking fluid supply continuously throughout the braking mode and the power mode.

21. The braking system of claim 14, further including a bias chamber receiving said reset valve, wherein fluid pressure in said bias chamber generates pressure forces on said reset valve to move said reset valve toward said reset contact element to cause movement of said reset valve into a closed position, said low pressure circuit including an actuator supply circuit and a bias chamber supply circuit for delivering braking fluid to said bias chamber, said reset valve controlling flow through said actuator supply circuit.

22. The braking system of claim 21, wherein said control valve is movable into a first position to connect said bias chamber supply circuit to a low pressure drain and a second position to connect said bias chamber supply circuit to a low pressure braking fluid supply.

23. The braking system of claim 13, further including a detent pin positioned to hold said reset valve in said open position when the engine is operated in the power mode.

24. The braking system of claim 23, wherein said reset pin includes an annular recess, said detent pin sized to engage said annular recess.

* * * * *